US006416055B1

(12) United States Patent
Shaw, Sr.

(10) Patent No.: US 6,416,055 B1
(45) Date of Patent: Jul. 9, 2002

(54) BOARD GAME AND METHOD FOR TEACHING FUNDAMENTAL ASPECTS OF ADVOCACY, DEBATING, NEGOTIATION AND JUDICIAL DECISION-MAKING

(76) Inventor: Kenneth Shaw, Sr., 31 Post La., Staten Island, NY (US) 10303

( * ) Notice: Subject to any disclaimer, the term of this patent is extended or adjusted under 35 U.S.C. 154(b) by 0 days.

(21) Appl. No.: 09/611,129

(22) Filed: Jul. 6, 2000

(51) Int. Cl.[7] ..... A63F 1/00

(52) U.S. Cl. ..... 273/257; 273/283; 273/287; 273/279; 273/243

(58) Field of Search ..... 273/292, 287, 273/283, 279, 308, 243, 257

(56) References Cited

U.S. PATENT DOCUMENTS

| | | | | | |
|---|---|---|---|---|---|
| 2,717,157 | A | * | 9/1955 | Dylewski | 273/135 |
| 2,930,621 | A | * | 3/1960 | Gross et al. | 273/134 |
| 3,889,955 | A | * | 6/1975 | Welch et al. | 273/134 D |
| 4,012,045 | A | * | 3/1977 | Vail | 273/134 B |
| 4,045,031 | A | * | 8/1977 | Arnold | 273/134 AT |
| 4,068,848 | A | * | 1/1978 | Lichtman et al. | 273/257 |
| 4,625,970 | A | * | 12/1986 | Childs et al. | 273/257 |
| 4,706,960 | A | * | 11/1987 | Nowacki et al. | 273/257 |
| 4,871,177 | A | * | 10/1989 | Mock | 273/256 |
| 5,009,429 | A | * | 4/1991 | Auxier | 273/240 |
| 5,137,279 | A | * | 8/1992 | Murphy et al. | 273/257 |
| 5,269,530 | A | * | 12/1993 | Miller | 273/243 |
| 5,316,482 | A | * | 5/1994 | Bryson | 434/129 |
| 5,362,061 | A | * | 11/1994 | Napolitano | 273/243 |
| 5,405,150 | A | * | 4/1995 | Loder | 273/430 |
| 5,429,371 | A | * | 7/1995 | Bledsoe | 273/272 |
| 5,657,988 | A | * | 8/1997 | Kavounas | 273/242 |

* cited by examiner

*Primary Examiner*—Benjamin H. Layno
*Assistant Examiner*—Dolores R. Collins
(74) *Attorney, Agent, or Firm*—Mitchell A. Stein

(57) ABSTRACT

A board game and method for teaching negotiation, advocacy and judicial decision-making skills to players, in which a board is providing having spaces upon which players may randomly, sequentially land. One of the players is determined at the outset to be the judge. The remaining players move about the board. The spaces conform to a plurality of categories, and pre-mixed questions, typically contained on cards, are sequentially read each time someone lands upon the space conforming to that category. The player who lands must answer the question; the other players must determine whether to object. Where an objection occurs, the players are placed in a debaters box, for a debating period. During that period, as determined by the judge, the players debate the issue and the judge, who provides full judicial making authority for the game, determines the protocol and the outcome of the debate. Where the outcome is a success to the objecting player, a letter is forfeited by the non-objecting player to him. Where the outcome is a success to the answering player, then the objecting player also forfeits a letter to the answering player. The winner of the debate also receives the letter that the answering player landed upon. Once a player wins all the letters that spell out a predetermined word, that player is the winner of the game. The categories and questions are predetermined to associate with a plurality of controversial subjects including "check yourself" wherein the players create a scenario in current events that will start a debate; "general information" wherein the players are asked about generally known facts; "race card" wherein the players are asked questions about race; "if" wherein the players are given a fact pattern and asked to present an outcome; and "debate box" where a controversial subject is provided.

6 Claims, 2 Drawing Sheets

BOARD GAME AND METHOD FOR TEACHING FUNDAMENTAL ASPECTS OF ADVOCACY, DEBATING, NEGOTIATION AND JUDICIAL DECISION-MAKING

FIELD OF THE INVENTION

The present invention relates to the field of board games, and more particularly to board games that educate the players in the manner and style of advocacy, debating and judicial decision making.

BACKGROUND OF THE INVENTION

It can be said that we live in a society that rewards the aggressor, the shrewd, and the silver-tongued debater. Yet, we also see the shy, considered and quite archetype winning in a variety of contexts. Indeed, much of the wealth in the United States is held by the very few—but little is known of them. On the other hand, there are some who are loud and provocative, and well-known for their acquisitions.

Regardless of whether the purpose is economic success or simple human persuasion, the art of debating is critical to achievement. Purposeful human dialogue is aimed at convincing someone of something—whether it be a purchasing decision (an advertisement, for example on television or radio), or a moral or ethical issue (vote for this candidate or referendum), or simple companionship (dating).

Legions of books and papers have been written on the art of persuasion and argument. Additionally, attorneys are placed through the trenches of the Socratic method in law school (allegedly) to hone their negotiation and advocacy skills. Salesmen are educated on analyzing human need and seeking to satisfy that need.

Beyond the educational arena or the "school of hard knocks," there is no known environment in which skillful advocacy techniques may be conveyed by way of a sporting match and learned in a manner that provides education while also creating an enjoyable atmosphere. Moreover, the "judge," the arbiter of all disputes, the bastion of human authority, is, in real terms, often reclusive, distant, and unreachable. Most people know nothing of the judiciary, except associate it with some level of fear or punishment. Judges do not frequently socialize and, if they do, spend the majority of their time with other judges or with other lawyers.

Thus, the typical individual in society also know very little about the legal system. All that is conveyed to that person is conveyed by way of the media—television and radio. Only the most unusual of circumstances (where the guilty appear to be let free or the innocent tried and convicted) reach public attention. Ordinary, every day circumstances, treated routinely in the hundreds if not thousands of daily situations, are unrecognizable and unknown to the normal person.

Board games, a common form of past time, have been relegated to money-making types of operations (like Monopoly) and, in today's world, are largely left for rainy days, or power failures. Typically, such board games lack the types of issues that are attractive to today's person, and thus are a mode of last resort.

Educational board games are known. For example, U.S. Pat. No. 6,032,957 to Kyosaki shows a game for educating the players in the aspects of finance, investing and accounting. However, board games directed towards teaching advocacy, negotiation, debate and decision-making are heretofore unavailable.

Accordingly, it is an object of the present invention to educate people in a board game environment to understand the delicate relationship between positions, arguments, and outcomes.

It is an additional object of the present invention to create a board game environment that permits people to assume and learn the different roles of plaintiff, defendant and judge.

It is a still further object of the present invention to teach people about a courtroom, by emulating the effects of a traditional courtroom, with decisions truly rendered by ones peers.

SUMMARY OF THE INVENTION

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

The foregoing objects and other objects of the invention are achieved through a board game and method for teaching negotiation, advocacy and judicial decision-making skills to players, in which a board is providing having spaces upon which players may randomly, sequentially land. One of the players is determined at the outset to be the judge. The remaining players move about the board.

Unique to the instant invention is the ability for players to shift between play and judgeship. The judge is given the "gavel" and a black robe, together with the authority to supervise the game, to issue penalties to the players, and to adjudicate disputes that are created by an answer followed by an objection. While rules are generally provided for play, an enormous amount of discretion is provided to the judge, thereby emulating the courtroom experience. Indeed, the debate, while lacking in the calling of witnesses, is nonetheless in front of the judge, and is followed by the judge's decision. The process, with the participation of the players at all levels, educates the players in the judicial process in a pleasant and exciting gaming environment.

The spaces on the game board conform to a plurality of categories, and pre-mixed questions, typically contained on cards, are sequentially read each time someone lands upon the space conforming to that category. The player who lands must answer the question; the other players must determine whether to object. Where an objection occurs, the answering player and the objecting player are both placed in a debaters box, for a debating period. During that period, as determined by the judge, the players debate the issue and the judge, who provides full judicial making authority for the game, determines the protocol and the outcome of the debate.

The remaining, non-answering and non-objecting players, listen to the dialogue and to the judge's actions, but otherwise are not permitted to participate (unless so indicated by the judge). The judge may punish anyone for "contempt" as determined by the judge. Contempt would include the failure to respect decorum or authority of the judge. This furthers the educational process. Penalties for contempt, as determined by the judge, include loss of turns, loss of a debate, or loss of winning letters.

Where the outcome of the debating period is a success to the objecting player, a letter is forfeited by the non-objecting player to him. Where the outcome is a success to the answering player, then the objecting player also forfeits a letter to the answering player. The winner of the debate also receives the letter that the answering player landed upon. Thus, the outcome of a debate is the winning of two letters by the winner of the debate, as determined by the judge.

Where there is no objection to the answer, the answering player receives the letter that he landed upon. This resembles the structure of the legal system, by providing the opportunity for greater victory as a result of winning a debate. The risks are higher to the participants, as are the rewards.

Once a player wins all the letters that spell out a predetermined word, that player is the winner of the game, and the game ends.

The categories and questions are predetermined to associate with a plurality of controversial subjects. It is understood that such categories and subjects can be varied, without deviating from the spirit of the invention, to conform with the social and societal interests of the time.

In the preferred embodiment, the categories include "check yourself" wherein the players create a scenario in current events that will start a debate; "general information" wherein the players are asked about generally known facts; "race card" wherein the players are asked questions about race; "if" wherein the players are given a fact pattern and asked to present an outcome; and "debate box" where a controversial subject is provided.

It is thus a feature of the present invention to provide a board game that educates the players in all aspects of judicial process, from assertion, to disputes, to resolution, and to consequences of such resolution.

The foregoing and other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements through the several views.

DETAILED DESCRIPTION OF THE PREFERRED EMBODIMENTS

Figure 1:
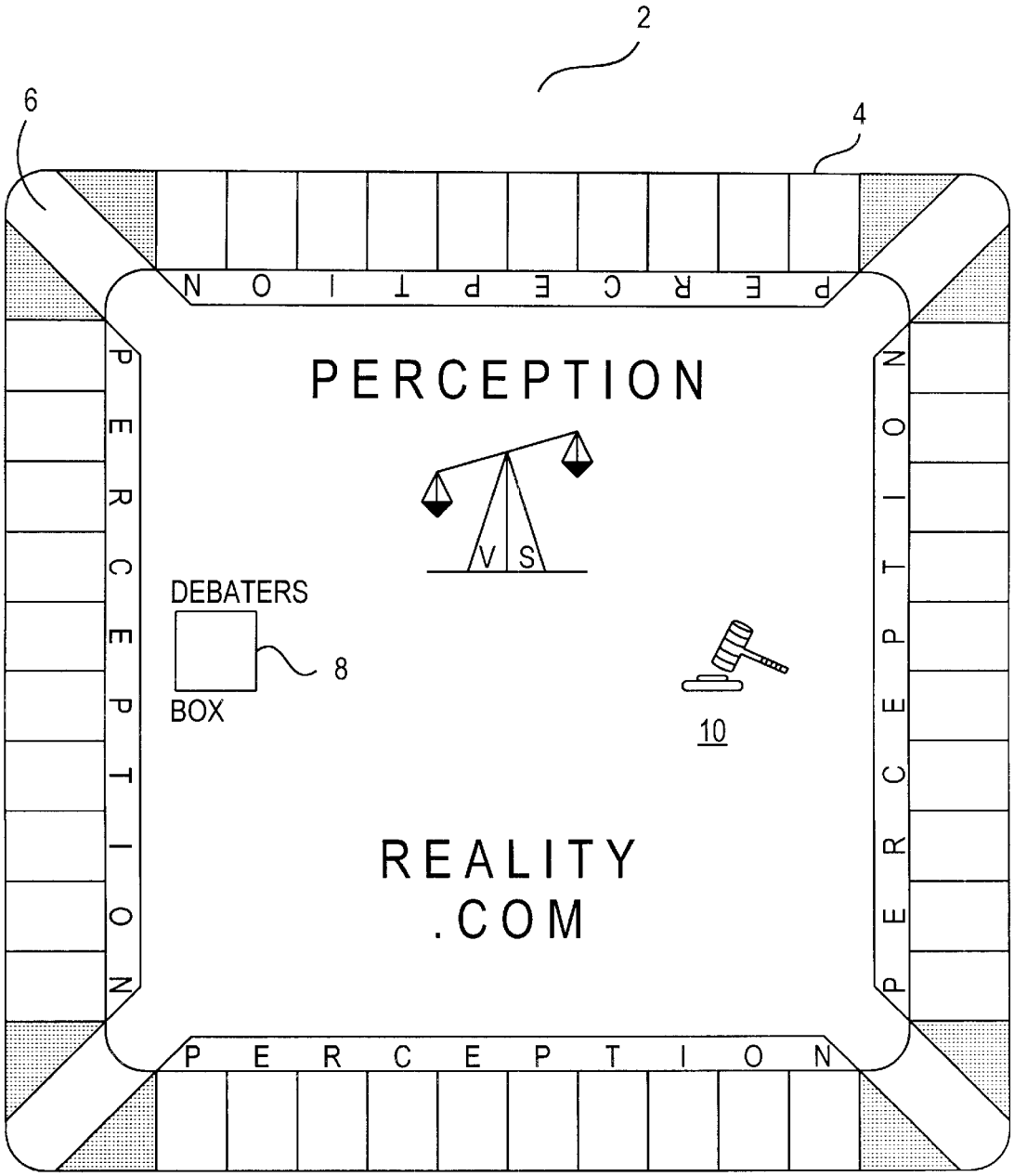
FIG. 1 is an overview of a preferred embodiment of the board in accordance with the subject invention.

In accordance with the subject invention, and with particular reference to FIG. 1, a game board 2 is shown having a number of spaces 4 about the periphery, and locations 6 at each of the corners. In the center of the board is a gaming area 10 in which cards, as described in greater detail below, can be placed, and dice thrown for determining locations of movement. Also contained on board 2 in gaming area 10 is a debaters box 8 in which gaming pieces and letters are placed during play.

It should be appreciated that the configuration of the board can be altered, without deviating from the letter or spirit of the subject invention, provided the method and mechanism are maintained for creating positions in response to questions, instituting objections and debate, and resolving the debate thereby instituted.

Figure 2:
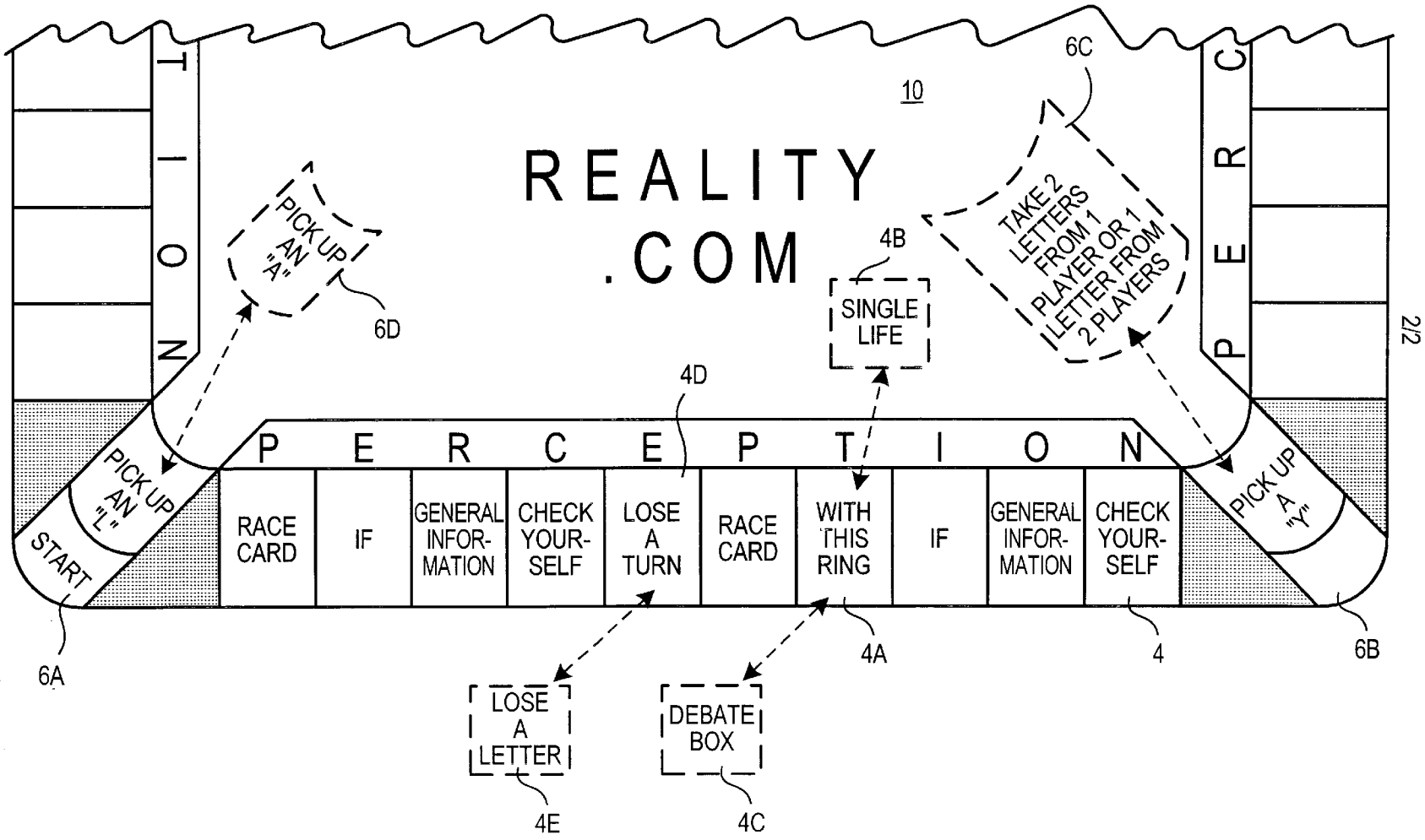
FIG. 2 is a breakout of a portion of the board, in accordance with the preferred embodiment of the subject invention.

In the preferred embodiment as shown in FIG. 1, the game is entitled "Perception v. Reality." Of important in this embodiment is the fact that "perception" and "reality" are the game-winning words. Stated otherwise, once a player receives all the letters that spell either word, that player is declared the winner. Observably in FIG. 2, the letters of "perception" comprise the game spaces 4, while the additional letters in the word "reality" (i.e., the "a," "1," and "y") are achieved by three of the four corner locations 6. (FIG. 2 is explained in greater detail, below.)

As in most games, each player selects an item (called a "gaming piece") to move about the board 2, in a clockwise fashion. Movement occurs by way of a roll of the dice, although any randomizing mechanism (or pseudo-randomizing mechanism) can be used as long as there is no favoritism afforded any one player. Each player starts in the corner marked "start" (which is location 6A in FIG. 2), and moves about clockwise, in accordance with the number of the roll on the dice, followed by movement of the respective gaming piece in a clockwise fashion. For purposes of the preferred embodiment, rolling "doubles" is of no significance.

Once a debate is initiated, the gaming pieces and letter in issue are placed in the debaters box. The debate is adjudicated by the judge. The judge is selected before the game is begun from the available players. In other words, one of the potential players becomes the judge, the remainder become the remaining players.

In the preferred embodiment, the judge wears a black robe and has a gavel (included with the game). The judge's rules are established generally by the judge, provided that the rules do not deviate from the general rules of the game. The judge adjudicates the debate and declares a winner. The players learn how to debate by seeing the mechanisms that win and persuade and those that lose with the loss of credibility. In subsequent plays, the players are each given opportunity to act as the judge and thereby be permitted to determine the victor of the debates.

With specific direction to FIG. 2, a breakout of a portion of the board 2 is shown, in which a section and the categories and spaces comprising that section are shown. In particular, game spaces 4 each conform to the following categories: "check yourself" wherein the players create a scenario in current events that will start a debate; "general information" wherein the players are asked about generally known facts; "race card" wherein the players are asked questions about race; "if" wherein the players are given a fact pattern and asked to present an outcome; and "debate box" where a controversial subject is provided. Also shown is "lose a turn," space 4D, in which a player forfeits the turn when landing upon that space. "Lose a turn" space 4D are on opposite sides of the board, and on the remaining two sides are "lose a letter 4E" in which a player forfeits a letters when landing upon that space.

"With this ring" space 4A also has, on the other side of the board, the designation "single life" space 4B. In "with this ring" space 4A, a player makes a statement concerning that player's perception of marriage. In "single life" space 4B, a player makes a statement concerning that player's perception of single life. On the remaining two portions of the board, the "with this ring" and "single life" space is occupied by a "debate box" 8C. In the "debate box" 8C, the player who lands there selects someone to debate, and draws a card for the topic of debate.

Each time a player lands in one of the locations 4 where the category is "race card," "if," "general information," "check yourself," and "debate box," a card is drawn by the judge from the pile of cards each separately indicated for that category. The question on that card is read by the judge to the player and to the group. The player is then given a period of time to provide an answer. In "with this ring," or "single life" the player provides an answer within the period, and no question is read.

Once an answer is stated, under the preferred embodiment, it cannot be changed. If the answer is not timely provided, the player's turn is forfeited. After the answer is provided, an objection period ensues. Where an objection is provided, the objecting player and answering player enter a debate period, and their respective gaming pieces, as well as the letter on which the answering player landed, are placed in debaters box 8.

Preferred Game Contents (a) 5 player pieces;

(b) 1 gavel;

(c) 1 set of dice;

(d) 104 playing cards, comprising the foregoing categories; and (e) 1 rule book.

Preferred Game Rules (a) Ages teens to adult.

(b) Minimum of 3 players, 2 players and 1 judge.

(c) Maximum-unlimited groups of 5 separate teams.

(d) Teams have a two minute limit in private conversation to agree to object to a response, and/or to provide a response. The judge will expedite debaters.

(e) In order to enter a debate, a player or team captain must state, "I object," only after hearing a response that that player or team captain disagrees with.

(f) When a player objects, the player becomes a defendant, the other player involved in the debate becomes the plaintiff.

(g) The burden of proof lies on the plaintiff.

(h) Losing letters—player decides which letter or letters to submit to the judge.

(i) If you don't have any letters, you can't lose any, nor can you be a plaintiff or defendant. Resume play.

(j) Any unchallenged response—resume play.

(k) An explanation to a statement or response is only required if there is an objection.

(l) A player's first response is final.

(m) Rolling a double with dice has no greater meaning than not rolling doubles. In both, the sum of the dice determines the extent of movement.

(n) Unneeded/extra letters—limit 1. Any excess are forfeited.

(o) A player can give deceptive responses to ensure a debate.

(p) A blank space in a question must be filled with any word or words.

(q) Responses are to be kept brief.

(r) After an objection, the winner of the debate takes the letter in play and one letter of their choice from the loser.

(s) The objective is to successfully spell out the word "perception," or "reality."

(t) "Single life"—debate or pick up the letter "I."

(u) "With this ring"—debate or pick up the letter "T."

(v) The judge is the "only" person with authority.

(w) Address the judge with respect, as either "Your Honor," "Sir," "Madam," or "Judge. "

(x) A ruling or decision handed down by the judge is not debatable.

(y) Judge bangs/taps the gavel, meaning total silence.

(z) All rulings/decisions are final.

(aa) The judge is not a player in the game, and does not move around the board.

(bb) The judge is an overseer and must keep players disciplined and respectful to other players' opinions and views.

(cc) The judge must be knowledgeable, firm, fair and impartial (unbiased).

(dd) Arguing or debating with the judge can result in a one to three letter fine, which is up to the discretion of the judge (e.g., contempt of court).

(ee) Serious offenses of discourtesy to the judge or to any other player, the judge can remove (eject) that player from the game.

(ff) Failing to follow instructions ordered by the judge can result in a fine of 1 to 3 letters (e.g., order in the court, or quiet down).

(gg) Judges can sustain or overrule any response to restore order and control.

(hh) Judges can set a time limit, and the player who is closest to the completion of spelling "perception" or "reality" is, at the time limit, declared the winner.

(ii) Judges can grant a session break with a five to ten minute recess for bathroom purposes, etc.

(jj) Returning to the board late can result in a 1–3 letter fine, or a verbal warning, as the judge sees fit, or for any other minor offense.

(kk) The judge must use his/her authority to maintain a mature debating forum with very little noise and absolutely no profanity.

(ll) The best judge will not be liked, but will be in a position of authority, thereby demanding respect.

(mm) "With this ring," a player must make a strong/powerful statement regarding a perception of what they believe about married life as a whole.

(nn) "Single life," a player must make a powerful statement regarding a perception of what they believe single life like is, as a whole.

(oo) When a player lands on a letter, the judge is to place that letter inside of the debaters' box.

(pp) Either the player or the judge initially reads the game card. Where the player reads the card, the judge must verify the accuracy of the reading. If additional information is required by the player, then the judge will provide the same.

(qq) Judges are to be sworn in, in the following manner. The player to the right of the Judge states: "All rise. Hearye, hearye, hearye. This is the Court of Perception v. Reality. The Honorable _____, presiding." Then the Judge states: "I, Judge _____, do solemnly swear to uphold the entirety of the rules of Perception v. Reality to the best and fullest of my abilities, and to remain fair, firm, respectful and impartial, while adjudicating the matters brought before me and achieving justice. Please be seated, this Court is now in Session."

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

I claim:

1. A board game for teaching negotiation, advocacy and judicial decision-making skills to players, comprising:

(a) a board having a number of spaces upon which the players may randomly, sequentially land;

(a) a plurality of such spaces having categorical designations and a series of pre-mixed questions in each such category;

(b) a location for engaging debate among two or more players upon the provision of an answer by one of such players of a question in a category as a result of that player's having landed upon that space, followed by an objection by another of such players to said answer;

(c) a player-based judicial decision making function to engage debate and determine whether the answer or the objection is more persuasive;

(d) a game-winning position determined by the collection of a plurality of letters that spell out a pre-determined word, and each one of said letters is associated with one or more of the spaces; and (e) wherein the consequence of the determination by the judicial decision-making function that the objection is more persuasive is the loss of a letter by the objecting player to the answering player, together with the win by the answering player of the letter associated with the space upon which the answering player landed.

2. The board game of claim 1, wherein the player-based judicial decision making function is satisfied by one of the players.

3. The board game of claim 1, wherein the categorical designations are selected from the group comprising: "check yourself" wherein the players create a scenario in current events that will start a debate; "general information" wherein the players are asked about generally known facts; "race card" wherein the players are asked questions about race; "if" wherein the players are given a fact pattern and asked to present an outcome; and "debate box" where a controversial subject is provided.

4. A board game method for teaching negotiation, advocacy and judicial decision-making skills to a plurality of players, having a game board, spaces on the board, and letters that spell a game-winning word, in which the letters are associated with the spaces on the board, comprising:

(a) determining a number for sequential movement by each of the plurality of players about the board;

(a) landing upon a space on the board in accordance with the number determined;

(b) reading a question in accordance with the space landed upon to the player who landed upon that space for that player to provide an answer;

(c) determining an object/non-object position in accordance with the answer;

(d) where the determination is object, providing a debate period;

(e) determining a debate winning player after completion of the debate period, based upon indicia of persuasiveness;

(f) forfeiting a letter that is part of the game-winning word by the non-debate winning player to the debate winning player, together with awarding to the debate winning player the letter associated with the space on the board on which the answering player landed; and (g) determining a game winning player based upon the first player to spell the game-winning word.

5. The board game of claim 4, wherein the indicia of persuasiveness is determined by one of the players acting as a judge during the course of play, and after completion of the debate period.

6. The board game of claim 4, wherein the spaces conform to categorical designations that selected from the group comprising: "check yourself" wherein the players create a scenario in current events that will start a debate; "general information" wherein the players are asked about generally known facts; "race card" wherein the players are asked questions about race; "if" wherein the players are given a fact pattern and asked to present an outcome; and "debate box" where a controversial subject is provided.

* * * * *